United States Patent [19]

Saneto

[11] 4,414,951

[45] Nov. 15, 1983

[54] VEHICLE FUEL CONDITIONING APPARATUS

[76] Inventor: Frank Saneto, P.O. Box 21421, Los Angeles, Calif. 90021

[21] Appl. No.: 290,660

[22] Filed: Aug. 6, 1981

Related U.S. Application Data

[63] Continuation-in-part of Ser. No. 230,649, Feb. 2, 1981.

[51] Int. Cl.[3] ..... F02B 75/10

[52] U.S. Cl. ..... 123/538; 123/536

[58] Field of Search ..... 123/536, 537, 538; 210/222, 695

[56] References Cited

U.S. PATENT DOCUMENTS

| | | | |
|---|---|---|---|
| 2,169,844 | 8/1939 | Marshall | 123/536 |
| 3,116,726 | 1/1964 | Kwartz | 123/538 |
| 3,228,868 | 1/1966 | Ruehn | 123/536 |
| 3,349,354 | 10/1967 | Miyata | 123/538 |
| 4,050,426 | 9/1977 | Sanderson | 123/538 |
| 4,188,296 | 2/1980 | Fujita | 210/222 |
| 4,299,700 | 11/1981 | Sanderson | 210/222 |
| 4,357,237 | 11/1982 | Sanderson | 210/222 |
| 4,366,053 | 12/1982 | Lindler | 210/222 |
| 4,372,852 | 2/1983 | Kovaks | 210/222 |

FOREIGN PATENT DOCUMENTS

| | | | |
|---|---|---|---|
| 2256379 | 5/1974 | Fed. Rep. of Germany | 123/538 |
| 835386 | 12/1938 | France | 123/536 |
| 55-153850 | 1/1980 | Japan | 123/538 |
| 814269 | 6/1959 | United Kingdom | 123/536 |

*Primary Examiner*—Ronald H. Lazarus

*Attorney, Agent, or Firm*—Wagner & Bachand

[57] ABSTRACT

Vehicle fuel conditioning apparatus is provided for improved combustion of hydrocarbon fuel tending to acquire an electrostatic charge during vehicle tank storage which charge inhibits full atomization of the fuel when mixed with air for combustion, the apparatus comprising magnetic flux means, such as magnet means on the fuel supply line of the vehicle between the fuel storage tank and an air and fuel mixer and atomizer: a plurality of axially extended and preferably annular magnet means; and a bracket maintaining said magnet means paraxial and preferably coaxial with said fuel line, the magnet means defining an axially extended flux condition in hydrocarbon fuel within the fuel line, the flux condition being adapted to strip electrostatic charge from fuel passing therethrough in subsequent fuel atomization facilitating relation, whereby fuel combustion is improved.

20 Claims, 7 Drawing Figures

VEHICLE FUEL CONDITIONING APPARATUS

REFERENCE TO RELATED APPLICATION

This application is a continuation-in-part of my earlier filed copending application, Ser. No. 06 230,649, filed Feb. 2, 1981, the specification and claims of which are hereby incorporated herein by reference.

TECHNICAL FIELD

This invention has to do with apparatus for improving the efficiency of combustion, and thus the efficiency of fuel utilization in vehicles having air and fuel mixers and atomizers, such as carburetors and fuel injectors. More particularly, the invention is concerned with improvements in devices for conditioning fuel to be combusted to make the fuel more readily atomized and combustible thereby, toward the ends of reduced pollution from unburned hydrocarbons, excessive carbon and nitrogen oxides, and the like, and more mileage from a given quantity of fuel in a particular vehicle.

The relentless advance in the cost of fuel has given added impetus to the search for expedients to get more useful work out of the fuel. In uses as diverse as the family car, the business airplane and the home heating system, increased thermal output from combustion is avidly sought. No less eagerly sought is a reduced contribution to air pollution from these hydrocarbon burning sources. In each case, more efficient combustion is the key, and the present invention enables such improvements in combustion simply and inexpensively.

BACKGROUND ART

There have been diverse patents issued concerning concepts for enhancing the operation of internal combustion engines by application of magnetic and electrical principles. Such patents include U.S. Pat. No. 4,074,670 to Roberts which teaches use of conductive wire coils around the fuel line to the engine which are alleged to be responsive to induction fields generated by various components of the engine, U.S. Pat. No. 4,050,426 to Sanderson in which an annulus surrounding a magnet is used to subject fuel to magnetic energy; U.S. Pat. No. 3,989,017 to Reece in which fuel is subjected to a magnetic field with a view to attracting droplets to warm cylinder walls to enhance vaporization and thus combustion efficiency; U.S. Pat. No. 3,976,726 to Johnson in which fuels are subjected to energy pulses at the resonant frequency of the fuel constituents; U.S. Pat. No. 3,349,354 to Miyata in which a plurality of like elongated magnets are arranged around the fuel passage; and U.S. Pat. No. 3,116,726 to Kwartz in which a magnetic field derived from an induction coil is used to treat the fuel before combustion.

While the value of magnetic energy use in hydrocarbon fuel conditioning has been recognized, prior workers have taught complex devices and extensive electrical wiring in some instances, and failed to arrange their magnetism sources for optimum benefit in fuel conditioning.

DESCRIPTION OF THE INVENTION

It is a major objective of the present invention to provide apparatus which will increase the efficiency of combustion of hydrocarbon fuels, particularly in vehicle usages, where increased combustion efficiency translates into increased power for passing and hill climbing, and increased mileage, and reduced pollution from incompletely combusted fuel products, and in a low cost, simple, and effective manner. It is another objective to provide apparatus of improved design for most effective utilization of magnetic flux fields in fuel precombustion conditioning. It is a highly particular objective to provide an apparatus readily connected to the fuel line of any vehicle to maintain a desired level of magnetic flux within the fuel passing to the carburetor, for the purpose of stripping off electrostatic charge which inhibits breakup of the fuel for atomization and thus costs efficiency.

These and other objectives of the invention to become apparent hereinafter, are realized in vehicle fuel conditioning apparatus for improved combustion of hydrocarbon fuel tending to acquire electrostatic charge during vehicle tank storage which charge inhibits full atomization of the fuel when mixed with air for combustion, the apparatus comprising an axial assembly of discrete magnetic bodies individually spaced by non magnetic spacers and arranged to define magnetic flux means providing an axially extended flux condition in the hydrocarbon fuel immediately in advance of fuel atomization, and means maintaining the bodies in assembed relation, the flux condition being adapted to strip electrostatic charge from fuel passing therethrough in subsequent fuel atomization facilitating relation, whereby fuel combustion is improved.

In typical embodiments, the magnetic flux means has a strength in excess of 6000 gauss; the axial assembly is positioned on the fuel line just before the fuel atomizer, and the apparatus further includes a bracket maintaining the body and spacer assembly paraxial with the vehicle fuel line in charge-stripping-effective proximity to the fuel atomizer; the assembly is tubular and the bodies and spacers define a continuation of the fuel line; the magnet bodies and non magnetic spacers are generally toroidal and coaxially aligned to define the tubular assembly; successive magnet bodies are of opposite polarity in the assembly, and in which the maintaining means comprises cooperating elements acting endwise on the magnetic bodies and spacers to maintain the same in coaxial, abutting, relation; and the magnetic flux means is defined within six inches of the atomizer.

In one embodiment of the invention, the bracket comprises for each magnetic flux means a bed having a shallow recess therein adapted to partially receive plural ones of the assemblies in fuel line adjacent relation, the embedded assemblies lying opposed across the fuel line in cooperating flux condition defining relation. In such and other embodiments of the invention, the magnetic flux means comprises a coaxial series of annular magnetic bodies of alternatively opposite polarity, and there is further included non magnetic annular spacers between adjacent magnet bodies, and the the magnet flux means defines a field of magnetic flux in excess of 450 Maxwell's per $cm^2$.

In a preferred embodiment of the invention, the bracket comprises a sleeve adapted to receive and maintain in assembled relation the magnet bodies and the non magnetic spacers, the sleeve being further adapted to communicate the fuel line with the fuel atomizer through a tubular passage defined by the assembled magnetic bodies and non magnetic spacers. There is further provided in these embodiments, tapped end plugs closing the sleeve at opposite ends thereof, the plugs abuttingly confining the magnet bodies and non magnetic spacers within the sleeve and defining fittings for connection to the fuel line and to the fuel atomizer respectively.

In particular use situations there may further be provided a shroud surrounding the sleeve in closed volume defining relation with the bracket sleeve, and shroud-defined means for filling the volume with a controlled atmosphere, such as an inert gas, e.g. helium.

In other embodiments, the air and fuel mixer and atomizer is a carburetor and the flux condition is located within four inches of the carburetor; the magnet bodies are of uniform size, generally toroidal and alternate in series with generally toroidal, like sized and shaped magnetic spacers, the bodies and spacers having coaxially assembled in tubular passage defining relation, and a passage liner, the apparatus being adapted to form a continued extent of the fuel line.

Preferably in this and other embodiments, the non magnetic spacers are nonmetallic and conductive, and are formed, e.g. of carbon; there are not less than three spacers alternating with not less than five magnet bodies, the polarity of adjacent magnetic bodies are opposite, the magnetic bodies and non magnetic spacers respectively divide the axial extent of the assembly substantially equally, and the assembly abuts the end plugs in snugly fitted relation.

The invention further contemplates the method of precombustion conditioning hydrocarbon vehicle fuel, which includes establishing a flux condition of not less than 450 Maxwell's per $cm^2$ next to the vehicle fuel atomizer by maintaining plural, discrete, generally toroidal magnets of successively opposite polarity coaxial with non magnetic spacers interposed therebetween, and passing the fuel through a tube defined by the bodies and spacers and progressively from a first polarity body to an opposite polarity body, and to another first polarity body repeatedly in sequence and toward the atomizer in electrostatic charge stripping relation.

THE DRAWINGS

The invention will be further described as to an illustrative embodiment in conjunction with the attached drawings, in which.

DESCRIPTION OF THE INVENTION

Figure 1:
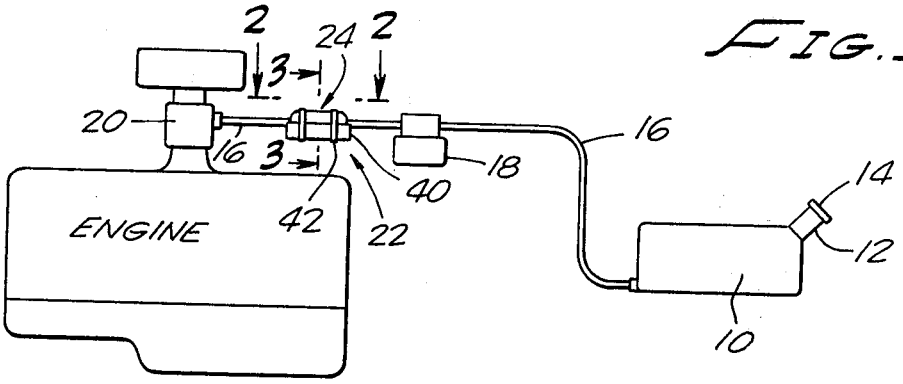
FIG. 1 is schematic view of an apparatus according to the invention for improving the combustion of hydrocarbon fuel by stripping electrostatic charge therefrom in passage to the carburetor or other fuel atomizing device.

With reference now to the drawings in detail, in FIG. 1 a fuel storage and delivery system is depicted, representative of systems in autos, ships, planes and trucks, which comprises the fuel storage tank 10, for gasoline or #2 kerosine (diesel) fuel storage which is refillable through filler neck 12, normally closed by cap 14. Fuel delivery line 16 leads from the storage tank 10 to a fuel pump 18 of conventional design, and beyond to carburetor 20 atop the engine. While a carburetor is shown as the fuel and air mixing and atomization device, systems having fuel injectors performing a comparable function are adantageously treated in accordance with the invention. The device of the invention is indicated at 22 in FIG. 1, positioned immediately adjacent the carburetor 20, e.g. 4 to 6 inches away, or closer or more distant providing the purposes of the invention are met.

Figure 2:
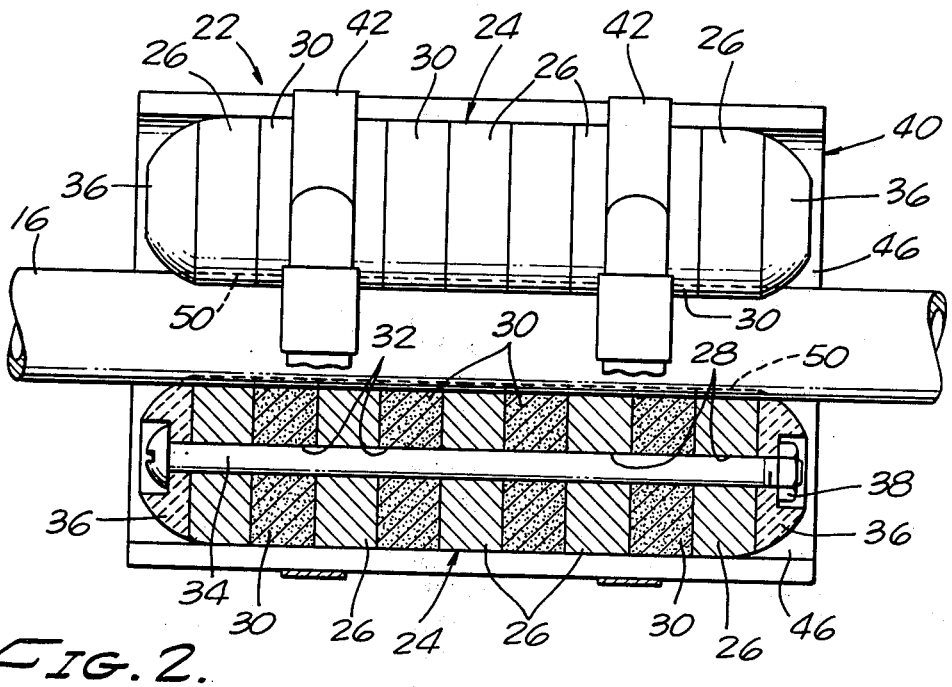
FIG. 2 is a plan view of the magnetic flux applying means thereof, taken on line 2—2 in FIG. 1.
Figure 3:
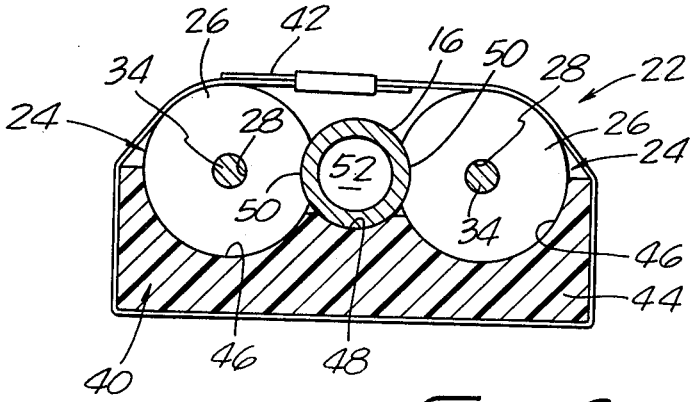
FIG. 3 is a view in vertical section thereof, taken on line 3—3 in FIG. 1.

With reference now to FIGS. 2 and 3, the device 22 is seen to comprise as illustrated, first and second magnetic flux means in the form of cylindrical assemblies 24 comprising an axially distributed series of ferrous metal magnet body discs 26 centrally apertured at 28 and alternated with non magnetic material, suitably carbon discs 30, also centrally apertured, at 32, both magnetic body discs and non magnetic material discs being axially mounted on through bolt 34. Vitreous, e.g. porcelein end caps 36 surmount the discs 26, 30, held there by bolts 34 having nuts 38. The magnetic and non magnetic discs 26, 20 substatially equally divide the axial extent of the assemblies 24. The overall length of the device 22 is not critical as will be apparent from later portions of the description, the device shown being about 2.5 inches in length.

The device 22 further includes a bracket 40 and a straps 42 which cooperate to mount the assemblies 24 in proper positional relation with the fuel line 16. The bracket 40 is formed of moderately heat resistant plastic or metal and comprises a rectangular block 44 with a pair of outboard, relatively deeper semicylindrical recesses 46 formed therein to receive partially, in embedding relation, the cylindrical assemblies 24, as shown. A shallower, central recess 48 similarly receives the fuel line 16, the fuel line adjacent portions 50 of the assemblies 24 being longitudinally dished to better nest against the fuel line and facilitate securely fastening of the device 22 to the fuel line. The device 22, or like assemblies of magnet bodies, with or without non magnetic spacers can be placed within the carburetor, just before the fuel atomization stage, preferably, or secured in like manner to the feed to a fuel injector apparatus. Similarly, the magnetic flux means may be electromagnetic if desired.

Figure 4:
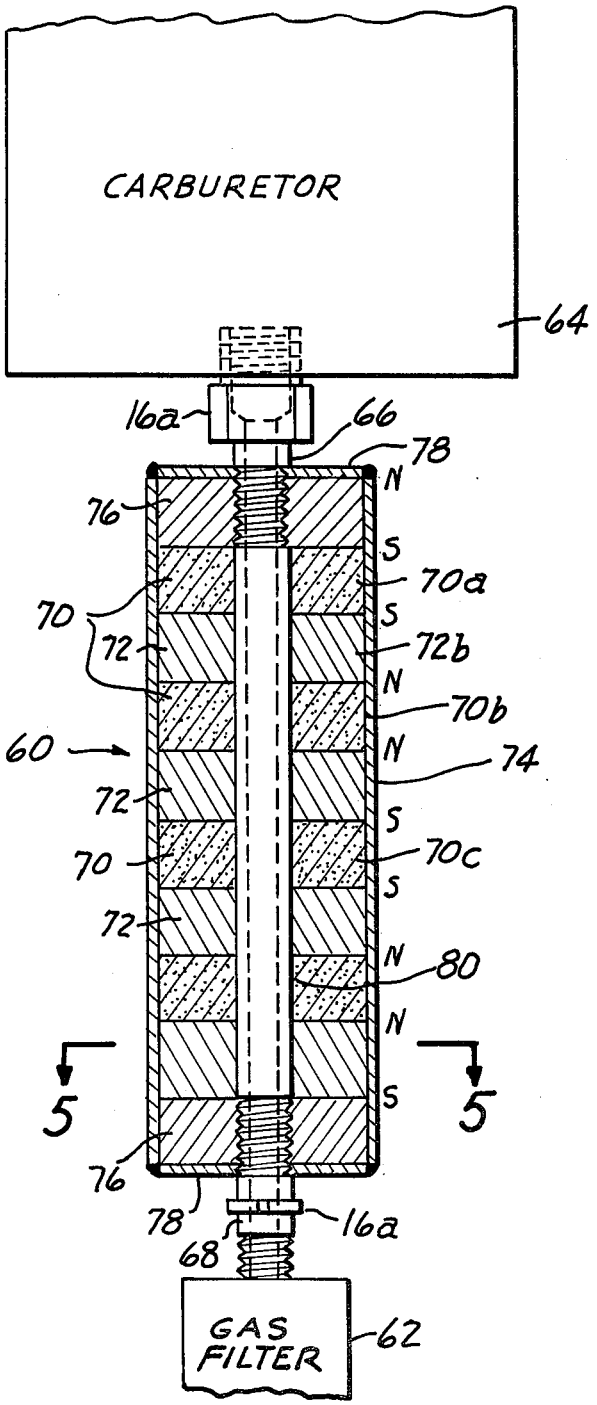
FIG. 4 is an axial section of a further embodiment of the invention.
Figure 5:
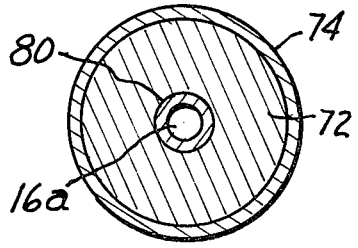
FIG. 5 is a transverse section thereof, taken on line 5—5 in FIG. 4.

In the preferred embodiment shown in FIGS. 4 and 5, the device 60 is in line with the fuel line **16*a*, located between the gasoline filter 62 and the atomizer, shown in the Figures as carbuetor 64. Threaded fittings 66, 68, secure the device 60 in its in-line position, as shown. The device 60 comprises an axially arranged series of magnetic bodies 70, each an annulus having smooth face walls, and non magnetic spacers 72, also each an annulus having smooth axial face walls. The magnetic bodies 70 and non magnetic spacers 72, are arranged coaxially, with their faces juxtaposed and no air gap between axial faces, to the extent practicable. To insure this assembly, a sleeve 74 is provided into which the magnetic bodies 70 and non magnetic spacers 72 are inserted serially. End caps 76, suitably tapped to thread connect to the fittings 66, 68, abut the magnetic bodies 70 and non magnetic spacers 72 assembly within the sleeve 74, and the sleeve ends are closed as by welding end plates 78 into place. A passage liner 80 is used between the end caps 76 to prevent fuel contact with the magnetic bodies 70 and non magnetic spacers 72**.

Figure 6:
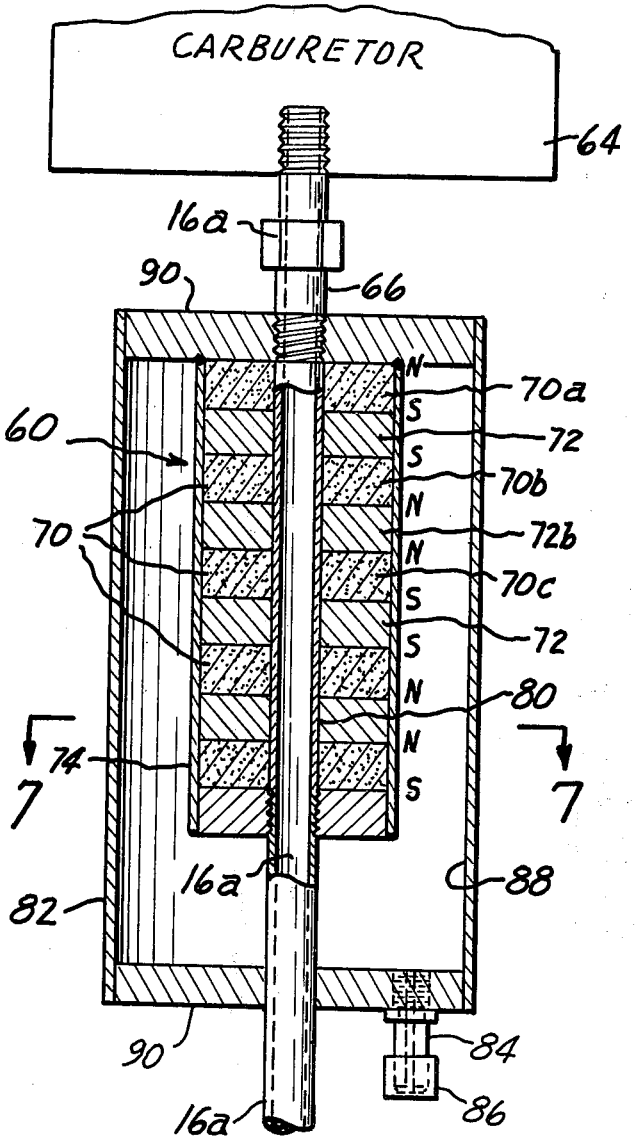
FIG. 6 is a view like FIG. 4, of a still further embodiment of the invention; and, FIG. 7 is a transverse section view thereof, taken on line 7—7 in FIG. 6.
Figure 7:
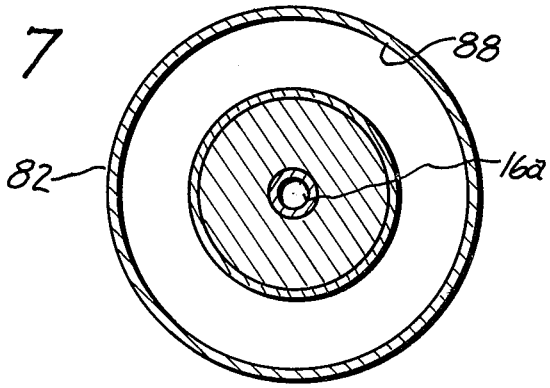

In another embodiment, shown in FIGS. 6 and 7, wherein like parts to the FIGS. 4 and 5 embodiment parts have like numerals thereto, a shroud 82 is provided surrounding the device 60, having an insulating gas port 84 normally closed by cap 86. The shroud 82 comprises a cylindrical wall 88 and end walls 90 assembled to be gas tight. A suitable inert gas such as helium is introduced into the shroud to surround the magnetic bodies 70, insulating them from engine compartment heat and by maintaining relatively lower operating temperature, improving the effectiveness of the device 60.

Materials of construction are not narrowly critical. Preferred materials include ceramic magnets, such as Grade V ceramic magnets, Alnico magnetics, and electromagnets coupled to 24 volt power supplies as are found on trucks and buses. The successive magnetic bodies are arranged to have their like poles opposed, thus the south pole of body 70*a* opposes the south pole of body 70*b*, while the north pole of body 70*b* is opposite, across non magnetic spacer 72*b*, the north pole of body 70*c*, and so on over the length of the device 60.

While not wishing to be bound to any particular theory of operation, it is believed that the magnetic field, e.g. comprising flux lines at 52 extended axially, see FIGS. 2 and 3, imposed by the device 22 acts to strip from the body of fuel being passed from the storage tank 10 to the carburetor 20, the electrostatic charge which normally accumulates on the fuel. This charge is believed to adversely affect the ability of the fuel to break up into atomized droplets of high fineness, whereby air mixing and atomization is less efficient owing merely to the presence of the unwanted charge. A magnetic flux field of sufficient intensity, e.g. 450 Maxwell's per $cm^2$, such as may be derived from the device 22 where the magnetic discs exhibit a strength of e.g. 6000 gauss, strips the unwanted charge, freeing the fuel to more readily break up and into finer portions, which burn more completely, and thus cleaner and with more output of energy. Thus the objectives of more efficient combustion for better mileage and cleaner air are met.

I claim:

1. In combination a vehicle fuel system and a vehicle fuel conditioning apparatus for improved combustion of hydrocarbon fuel tending to acquire electrostatic charge during vehicle tank storage which charge inhibits full atomization of the fuel when mixed with air for combustion, said apparatus, being positioned between the vehicle tank storage and a fuel atomizing device and comprising an axial assembly of discrete magnetic bodies individually spaced by non magnetic spacers and arranged to define magnetic flux means providing an axially extended flux condition in said hydrocarbon fuel immediately in advance of fuel atomization, means maintaining said bodies in assembled relation, means defining a closed volume about said assembled bodies, and an inert gas within said closed volume means, said flux condition being adapted to strip electrostatic charge from fuel passing therethrough in subsequent fuel atomization facilitating relation, whereby fuel combustion is improved.

2. Vehicle fuel conditioning apparatus according to claim 1, in which said magnetic flux means has a strength in excess of 6000 gauss.

3. Vehicle fuel conditioning apparatus according to claim 1, in which said axial assembly is positioned on the fuel line just before the fuel atomizer, and including also a bracket maintaining said body and spacer assembly paraxial with the vehicle fuel line in charge-stripping-effective proximity to said fuel atomizer.

4. Vehicle fuel conditioning apparatus according to claim 3, in which said assembly is tubular and said bodies and spacers define a continuation of said fuel line.

5. Vehicle fuel conditioning apparatus according to claim 4, in which said magnet bodies and non magnetic spacers are generally toroidal and coaxially aligned to define said tubular assembly.

6. Vehicle fuel conditioning apparatus according to claim 5, in which successive magnet bodies are of opposite polarity in said assembly, and in which said maintaining means comprises cooperating elements acting endwise on said magnet bodies and spacers to maintain the same in coaxial, abutting, relation.

7. Vehicle fuel conditioning apparatus according to claim 3, in which said magnetic flux means is defined within six inches of said atomizer.

8. Vehicle fuel conditioning apparatus according to claim 3, in which said bracket comprises for each magnet means a bed having a shallow recess therein adapted to partially receive plural ones of said assemblies in fuel line adjacent relation, said embedded assemblies lying opposed across said fuel line in cooperating flux condition defining relation.

9. Vehicle fuel conditioning apparatus according to claim 3, in which said magnetic means comprises a coaxial series of annular magnetic bodies of alternatively opposite polarity, and including also non magnetic annular spacers between adjacent magnetic bodies.

10. Vehicle fuel conditioning apparatus according to claim 9, in which said magnet means defines a field of magnetic flux in excess of 450 Maxwell's per $cm^2$.

11. Vehicle fuel conditioning apparatus according to claim 9, in which said bracket comprises a sleeve adapted to receive and maintain in assembled relation said magnetic bodies and said non magnetic spacers, said sleeve being further adapted to communicate said fuel line with said fuel atomizer through a tubular passage defined by said assembled magnetic bodies and non magnetic spacers.

12. Vehicle fuel conditioning apparatus according to claim 11, including also tapped end plugs closing said sleeve at opposite ends thereof, said plugs abuttingly confining said magnet bodies and non magnetic spacers within said sleeve and defining fittings for connection to said fuel line and to said fuel atomizer respectively.

13. Vehicle fuel conditioning apparatus according to claim 12, including also a shroud surrounding said sleeve in closed volume defining relation with said bracket sleeve, and shroud defined means for filling said volume with a controlled atmosphere.

14. In a vehicle fuel conditioning apparatus for improved combustion of hydrocarbon fuel tending to acquire electrostatic charge during vehicle tank storage which charge inhibits full atomization of the fuel when mixed with air for combustion, the improvement of said apparatus comprising an axial assembly of discrete, coaxial annular, magnetic bodies of alternatively opposite polarity individually spaced by non magnetic annular spacers and arranged to define magnetic flux means providing an axially extended flux condition in said hydrocarbon fuel immediately in advance of fuel atomization, means maintaining said bodies in assembled relation, a bracket sleeve receiving and maintaining said body and spacer assembly paraxial with the vehicle fuel line and communicating said fuel line with said fuel atomizer through a tubular passage defined by said assembled magnetic bodies and non magnetic spacers, tapped end plugs closing said sleeve at opposite ends thereof, said plugs abuttingly confining said bodies and spacers within said sleeve and defining fittings for connection to said fuel line and to said fuel atomizer respectively, and a shroud surrounding said sleeve in closed volume defining relation with said sleeve bracket and having an inert gas within said volume and means for filling said volume with said inert gas, said flux condition being adapted to strip electrostatic charge from fuel passing therethrough in subsequent fuel atomization facilitating relation, whereby fuel combustion is improved.

15. Vehicle fuel conditioning apparatus according to claim 14, in which said inert gas is helium.

16. Vehicle fuel conditioning apparatus according to claim 1, in which said air and fuel mixer and atomizer is a carburetor and said flux condition is located within four inches of said carburetor.

17. Vehicle fuel conditioning apparatus according to claim 1, in which said magnet bodies are of uniform size, generally toroidal and alternative in series with generally toroidal like sized and shaped magnetic spacers, said bodies and spacers being coaxially assembled in tubular passage defining relation, said apparatus being adapted to form a continued extent of said fuel line.

18. Vehicle fuel conditioning apparatus according to claim 1, in which said non magnetic spacers are nonmetallic and conductive.

19. Vehicle fuel conditioning apparatus according to claim 18, in which said non magnetic material is carbon.

20. Vehicle fuel conditioning apparatus according to claim 1, in which not less than three spacers alternate with not less than five magnet bodies, said magnetic bodies and non magnetic spacers respectively dividing the axial extent of the assembly substantially equally, said assembly abutting said end plugs in snugly fitted relation.

* * * * *